US007032408B2

(12) United States Patent
Dentella et al.

(10) Patent No.: US 7,032,408 B2
(45) Date of Patent: Apr. 25, 2006

(54) REFRIGERATOR WITH INTERNAL COMPARTMENT DIVISIBLE INTO INDEPENDENT TEMPERATURE ZONES

(75) Inventors: Daniela Dentella, Cinisello Balsamo (IT); Fabio Gastaldello, Malnate (IT); Marco Signa, Arcisate (IT); Davide Braggion, Besozzo (IT)

(73) Assignee: Whirlpool Corporation, Benton Harbor, MI (US)

( * ) Notice: Subject to any disclaimer, the term of this patent is extended or adjusted under 35 U.S.C. 154(b) by 168 days.

(21) Appl. No.: 10/495,691

(22) PCT Filed: Oct. 15, 2002

(86) PCT No.: PCT/EP02/11503

§ 371 (c)(1),
(2), (4) Date: May 14, 2004

(87) PCT Pub. No.: WO03/042613

PCT Pub. Date: May 22, 2003

(65) Prior Publication Data

US 2005/0155372 A1 Jul. 21, 2005

(30) Foreign Application Priority Data

Nov. 16, 2001 (IT) ..... MI2001A2427

(51) Int. Cl.
*F25D 11/02* (2006.01)

(52) U.S. Cl. ..... 62/441; 62/187; 62/227; 62/440

(58) Field of Classification Search ..... 62/187, 62/227, 440, 441, 448
See application file for complete search history.

(56) References Cited

U.S. PATENT DOCUMENTS

| | | | | |
|---|---|---|---|---|
| 3,027,732 | A * | 4/1962 | Mann et al. | 62/187 |
| 4,671,074 | A * | 6/1987 | Gostelow et al. | 62/186 |
| 4,924,680 | A * | 5/1990 | Janke et al. | 62/187 |
| 6,779,357 | B1 * | 8/2004 | Fann | 62/285 |
| 6,915,657 | B1 * | 7/2005 | Wood | 62/371 |

* cited by examiner

*Primary Examiner*—Melvin Jones
(74) *Attorney, Agent, or Firm*—Robert O. Rice; Stephen Krefman; John F. Colligan

(57) ABSTRACT

A refrigerator comprises a refrigerator housing having a compartment, this latter presenting side walls having brackets for at least one removable element for supporting products to be preserved and separating the compartment into separate zones, the compartment having a rear wall in correspondence with which an evaporator is present, in the rear wall there being provided a plurality of apertures disposed in overlying planes and communicating with the evaporator, an electronic circuit being provided for measuring the internal temperature of the compartment. The evaporator is located in correspondence with rear wall apertures of the compartment, on these latter there being disposed motor-driven fans, the fans being mutually independent to enable different independent temperatures to be created within the different compartment zones.

16 Claims, 3 Drawing Sheets

REFRIGERATOR WITH INTERNAL COMPARTMENT DIVISIBLE INTO INDEPENDENT TEMPERATURE ZONES

The present invention relates to a refrigerator in accordance with the introduction to the main claim. Herein, the term "refrigerator" means either an upright refrigerator in which the temperature is normally greater than −2° C., or a freezer in which the temperature is maintained constantly below 0° C.

As is well known, in a refrigerator (static or forced-air) it is very important to achieve a correct temperature in each of its preservation or freezing compartments in order to obtain optimum preservation of the foods stored in it. In particular, it is well known that different foods storable in the compartment for preservation require different preservation temperatures, as for example the case of meat and fish compared with vegetables or dairy products.

It is known to form within a refrigeration compartment a plurality of preservation zones at different temperatures, for example by creating actual preservation zones provided with a separate perimetral structure and an independent access door. These zones can be positioned inside the refrigeration compartment.

The aforesaid solution involves high construction costs and can also be complicated to use.

Also known, for example from EPO 805320 which forms a pre-characterising part of the main claim of the present document, is a forced-air refrigerator having a preservation compartment divided into several preservation zones by usual removable elements or shelves arranged to support the products to be preserved. Air can be drawn into each of these zones from an evaporator positioned within a predefined containing cavity created within the refrigeration cell behind the rear wall of the preservation compartment in which the usual forced air circulation fan is also located; the air penetrates into the various zones of the refrigeration compartment through apertures formed in the rear wall of this compartment at different heights in parallel planes. The quantity of air which penetrates into the various zones is set and controlled by a rotary blade provided on a rod supporting a plurality of deflectors: this blade is positioned vertically behind the rear wall of the refrigeration compartment below the evaporator such that the deflectors lie in correspondence with the apertures provided in the rear wall of the refrigeration compartment.

By moving the rotary blade about its axis the air can be distributed in a balanced manner within the various zones of the refrigeration compartment, for example such as to feed cold air intensely into a part of the high temperature compartment.

This solution is applicable only in a forced-air refrigerator, it is of complicated and costly construction, it does not enable air to circulate within a single zone of the refrigeration compartment to achieve therein a temperature totally independent of that of the other zones of the refrigeration compartment, and can give rose to reliability and maintenance problems.

Finally, from a preceding patent application of the same Applicant a refrigerator is known, in the compartment of which there is positioned at least one removable element for supporting foods, for example a shelf, box or the like, comprising an element to be positioned on supports present on opposing walls of the refrigeration compartment.

Associated with said element there are provided setting means enabling the internal temperature of the refrigeration compartment to be set and the set temperature value to be transferred to means for controlling the refrigeration circuit of the refrigerator.

The said solution enables excellent control of the internal temperature of a refrigeration compartment to be achieved.

However the aforesaid patent application did not have as an object the obtaining of zones at different mutually independent temperatures within the refrigeration compartment.

An object of the present invention is to provide a refrigerator, within the compartment of which zones at mutually independent temperatures can be obtained.

Another object is to provide a refrigerator of the stated type which is of simple and reliable construction.

A further object is to provide a refrigerator of the stated type which enables localized control of the temperature of each zone into which the refrigeration compartment is divided.

Another object is to provide a refrigerator of the stated type which is simple and immediate to use.

These and further objects which will be apparent to the expert of the are attained by a refrigerator in accordance with the accompanying claims.

The present invention swill be more apparent from the accompanying drawing, which is provided by way of non-limiting example and in which.

Said figures schematically show a refrigerator indicated overall by 1. In the example, the refrigerator is an upright refrigerator and comprises a housing 1A bounding an internal compartment 2 having opposing side walls 3, 4 and a rear wall or shoulder 5. Usual supports 6 are present on the lateral walls, to support shelves 7K, 7W, 7X formed in accordance with a patent application already filed in the name of the same Applicant.

Figure 3:
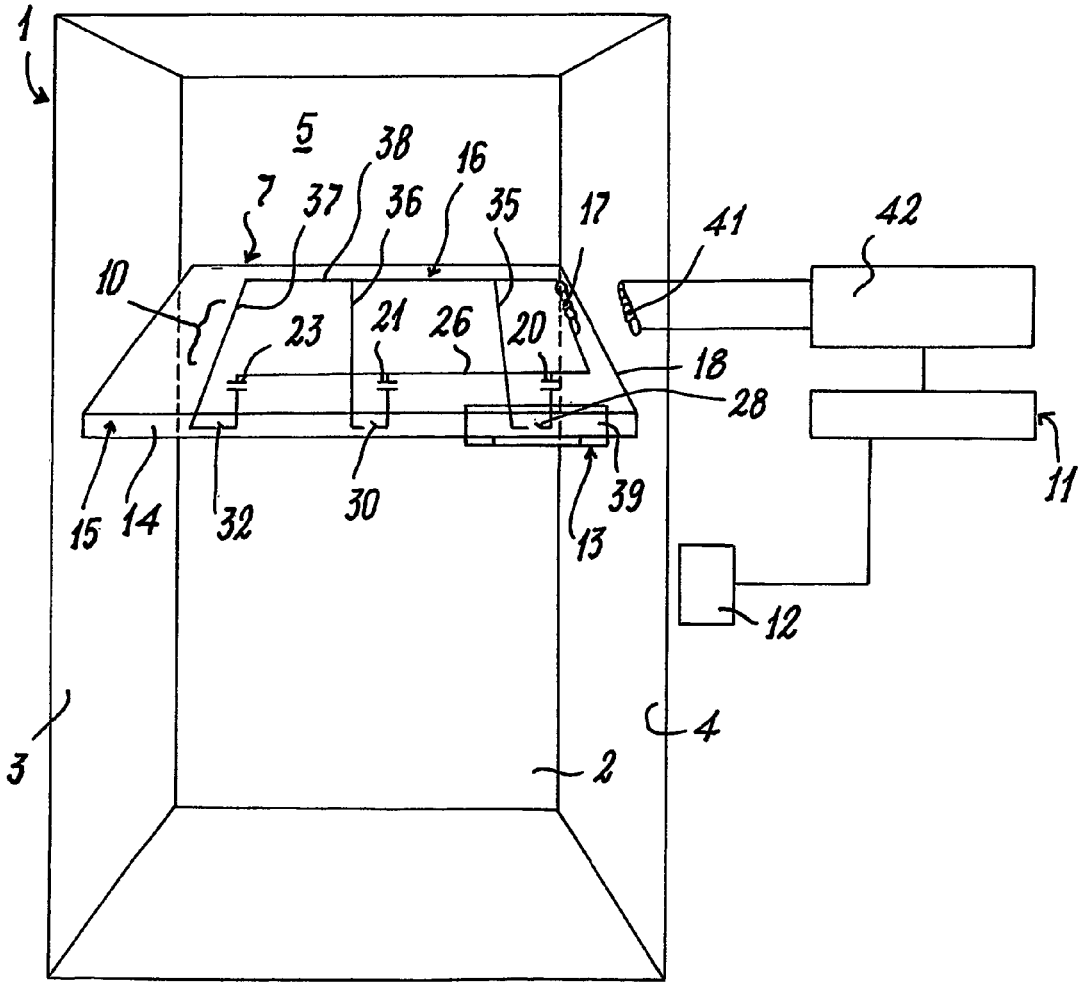
FIG. 3 is a schematic front perspective view of a shelf used in the refrigerator of FIG. 1 but forming the subject of a preceding filing of the same Applicant.

Each shelf 7K, 7W, 7X comprises (see FIG. 3) means 10 to enable the internal temperature of the compartment 2 (or a temperature range corresponding to a determined food category) to be set and possibly to be measured. These means 10 cooperate with control means 11 for controlling the operation of the refrigerator 1, by controlling and regulating, on the basis of the temperature setting imposed by the setting means 10, the operation of a usual refrigeration circuit schematically shown in FIG. 3 and indicated by 12.

The setting means 10 are associated with operating means 13 positioned preferably on a front face 14 of the body 15 of the shelf 7. These means for setting the internal temperature of the compartment 2 are an electrical and/or electronic circuit 16 suitably inserted into the body 15, for example an electrical circuit of passive type defined by an RLC resonant circuit and comprising an inductor 17 positioned in correspondence with a lateral face 18 of the body 15 of the shelf 7K, 7W or 7X and a plurality of capacitors (for example three, as in the figures where they are indicated by 20, 21 and 23) of various capacitances. Each capacitor is connected on one side to an electrical line 26 connected to one end of the inductor 17, and on the other side to a change-over switch (28, 30 and 32 respectively) arranged to connect each capacitor to a second electrical line 35, 36 and 37 respectively, connected to an electrical branch 38 connected to the other end of the inductor 17.

Using the operating means 13, a different change-over switch can be activated to connect the corresponding capacitor to the inductor in such a manner as to modify the resonance frequency of the circuit 16.

The operating means 13 can be defined by a plurality of pushbuttons connected to the various capacitors and which, when pressed, result in the selection of a temperature suitable for preserving different foods. Alternatively, the operating means 13 can be defined by a slidable selector 39 movable along the face 14 of the body 15 of the shelf 7. Hence a respective desired temperature within the compartment 2 can be made to correspond to each frequency variation of the circuit 16, this temperature being selected for example via the selector 39.

An inductor 41 is positioned in that wall 4 of the compartment 2 which faces the face 18 of the body 15 of the shelf 7K, 7W or 7X, and is connected to an oscillating circuit 42 connected to the refrigerator control means 11, for example a microprocessor circuit.

On powering the oscillating circuit 42, the circuit 16 is activated, so that each variation in the resonance frequency of said circuit is noted as a variation in the resonance of the circuit 42, this being then determined by the control circuit or means 11.

Moreover, any deviation in the actual temperature from that set for each shelf 7K, 7W, 7X can be determined directly by the circuit 11, as this temperature variation results in a proportional variation in the capacitance of the capacitor selected by the circuit 16 and hence a variation in the resonance frequency of said circuit (determined by the control circuit 11). This circuit acts on the refrigeration circuit 12 on the basis of this determination. Alternatively each zone of the cell can be provided with temperature sensors, positioned for example in correspondence with the side wall.

Each shelf 7K, 7W, 7X comprises a perimetral frame 7A (where the operating means 13 are positioned), a central part 7B (containing the means 10) and a frame insert 7C to be positioned to the front of the rear wall or shoulder 5 of the compartment 2. This rear wall is defined by a panel 60 presenting a projecting central portion 61 disposed in a substantially central position on the wall 5. In the portion 61 there are provided a plurality of through apertures 63 where frames 64 are positioned for supporting motor-driven fans 65 operated and controlled in their operation by the control circuit 11. Said circuit can control not only the speed of the fans 65 but also the speed of the compressor motor if a variable-speed compressor is used.

Other through apertures 66 are provided in lateral portions 67 of the panel 60 to the side of the projecting portion 61, and are covered by grilles 69.

To the rear of the panel 60, between it and a rear portion 70 of the housing 1A, an evaporator 71 for the refrigeration circuit is positioned vertically within a cavity 72 (or a conduit positioned centrally on the wall 5 of the compartment 2) of the panel 60 defined by the projecting portion 61. Preferably the evaporator consists of several portions of finned tube connected together ands has a suitable length, for example equal to that of the portion 61.

By virtue of the invention, zones can be obtained within the compartment 2 which are at different mutually independent temperatures based on the type of foods placed on the shelf 7K, 7W or 7X. In this manner zones can be obtained for preserving meat and fish, vegetables and dairy products; said zones are not however predetermined, and can be mutually exchanged.

Figure 1:
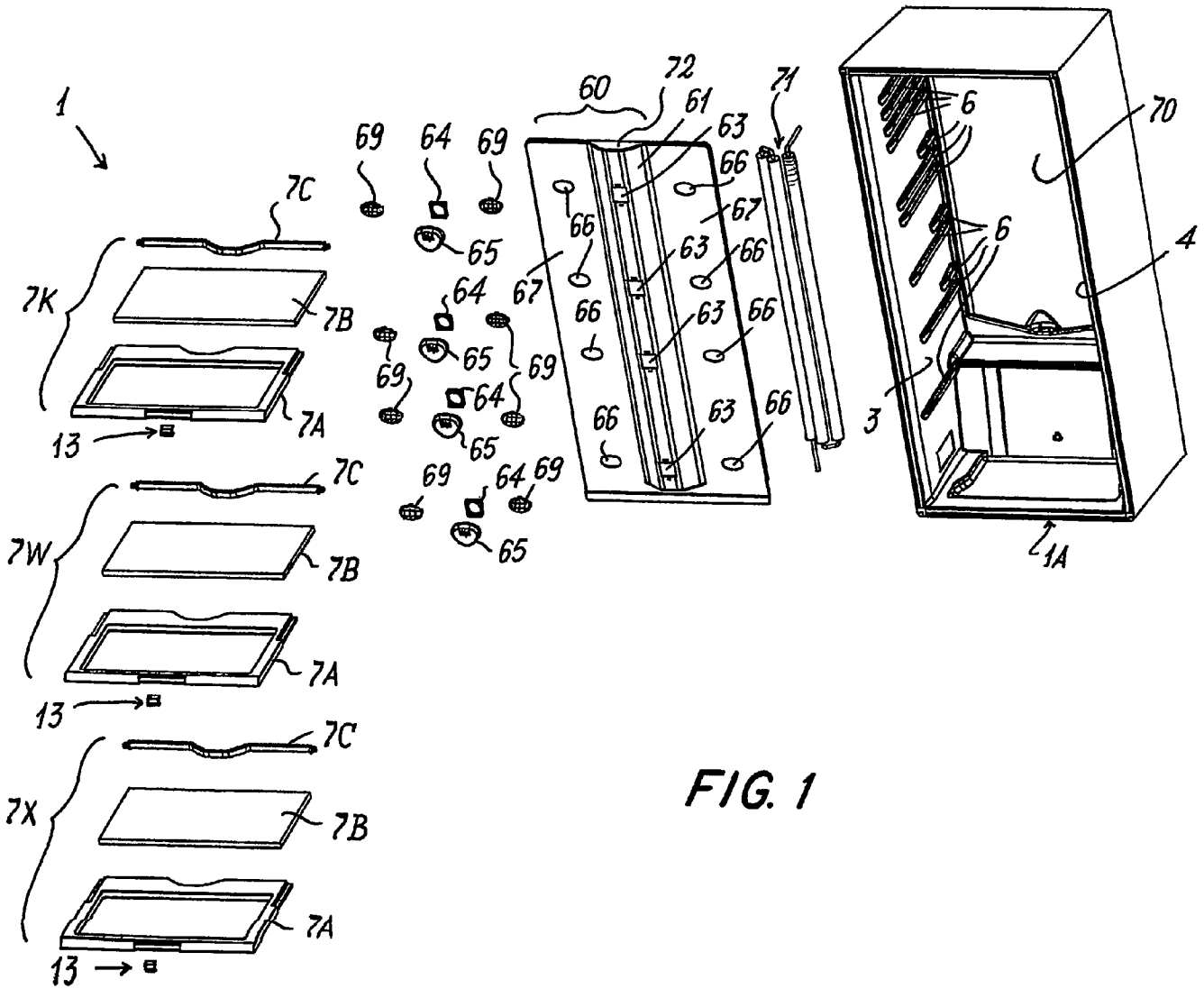
FIG. 1 is an exploded partial front perspective view of a refrigerator according to the invention.
Figure 2:
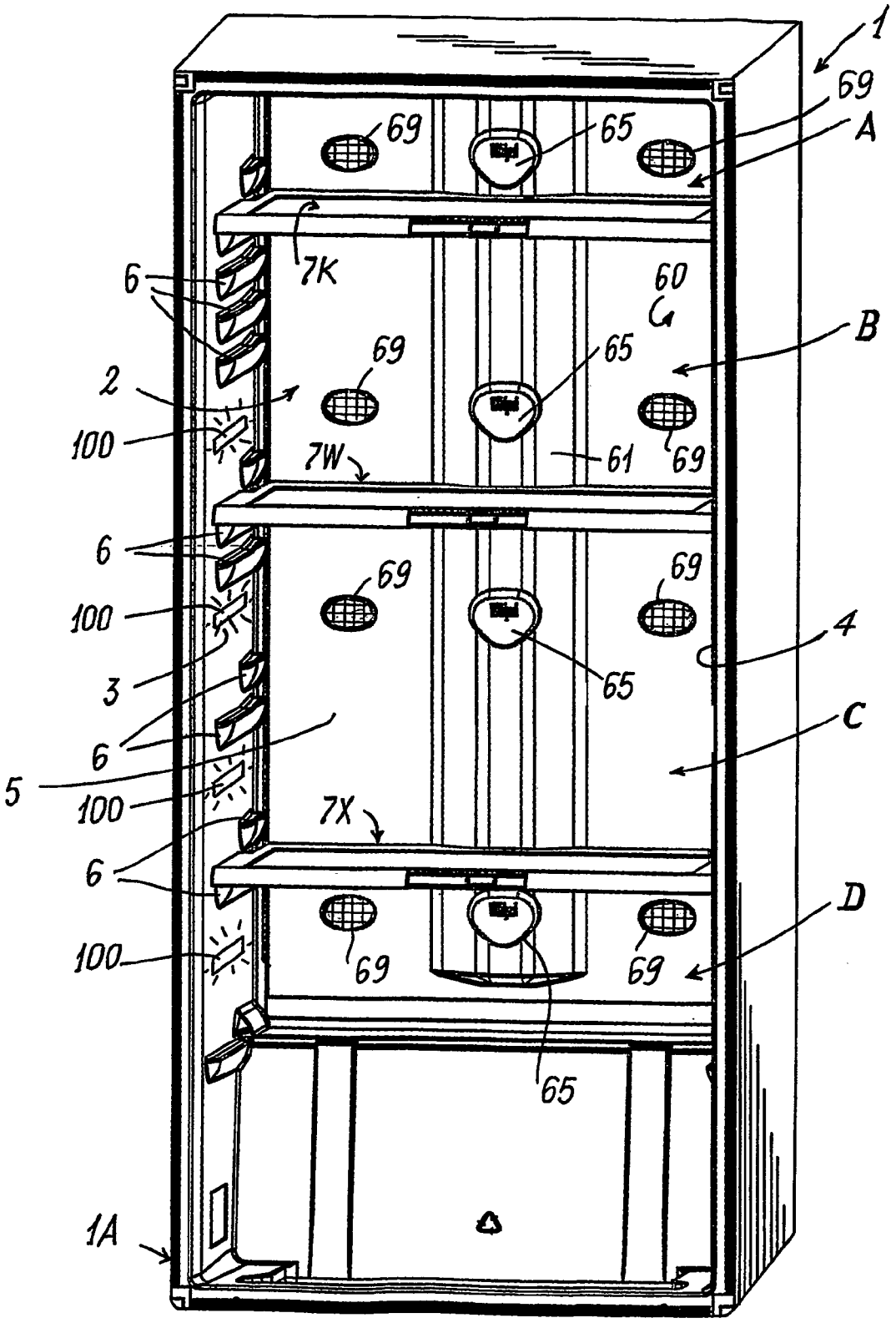
FIG. 2 is a front perspective view of the refrigerator of FIG. 1.

It will now be assumed that a refrigerator such as that described is to be used. With reference to FIG. 2, this shows four zones: a first zone A positioned above the shelf 7K, a second zone B positioned between the intermediate shelf 7W and the upper shelf 7K, a third zone C positioned between the shelves 7W and 7X, and a fourth zone D positioned below the shelf 7X (between this latter and a usual lower drawer, not shown). The apertures 63 with the fans 65 and the apertures 66 are present at each zone of the refrigeration compartment.

Using the operating means 13 of each shelf 7, a particular required temperature is set for that zone of the compartment 2 above the shelf. On the basis of the aforesaid setting, the control means 11 act on the refrigeration circuit 123 and on the fans 65 which forcibly feed into the various zones A, B, C, D of the compartment 2 cold air withdrawn from the cavity 72 containing the evaporator 71. The cold air is fed in the required quantity and for the required time to enable the temperature set by the user to be achieved within the aforesaid zones of the compartment 2. At the same time warmer air returns to the cavity 72 through the apertures 66.

The temperature is measured by the said circuit 16 of each shelf 7K, 7W, 7X which then enables the control means 11, in the manner known from the preceding patent application in the name of the same Applicant, to determine this temperature and to adjust the speed of the fans 65 in order to maintain the temperature achieved. If, via the operating means 13, the user sets a change to the temperature in the compartment above a shelf, the means 11 sense this change (in the manner already described in the aforesaid already filed patent application in the name of the same Applicant) and act in the described manner on the fans 65 to enable the required temperature to be achieved within the compartment.

According to a further characteristic of the invention, particular colours generated in the various zones A, B, C and D of the compartment 2 are associated with the various temperatures settable by the user. The preferably diffused coloration in the various zones can be obtained by fluorescent lamps or light emitting diodes (LEDs), or by coloured plastics (or coloured adhesives) positioned in correspondence with (superposed on) white light sources, or another known means. In FIG. 2, the coloured light generating member is indicated overall by 100 and is positioned on the wall 3 in correspondence with the each zone A, B, C, D of the compartment 2. As an alternative, the side wall of the cell can be provided with a light channel arranged to assume a different coloration within the portion corresponding to a zone of the cell. This different coloration is for example obtainable by using multicolour LEDs of RGB type.

The aforesaid "calorimetric" characteristic enables the consumer to manage these optimized zones or spaces without difficulty: for example, the optimum zone for preserving meat can be of intense blue colour, whereas that for dairy products can be of a different shade of blue or of another colour, for example white. To prevent difficulty in understanding the colour-food concept, food products are associated in groups for which optimum common preservation conditions have been defined: hence a different colour will be associated with each category.

This solution facilitates food storage: in this respect, after selecting via a control panel the type of food to be inserted into the compartment 2, the selection is automatically indicated to the user by a display on the door or by the internal coloration of the cell. As the colour is related to a category of foods, this will hence indicate the correct position where the food is to be placed.

Besides facilitating storage, the colorimetric solution within the compartment 2 can be useful for two other reasons: once the user is familiar with the food-colour mechanism, on the one hand the internal coloration of the compartment 2 is useful as a general indicator of what is contained in the refrigerator (for example that meat or vegetables are lacking because a particular colour is missing), and on the other hand it can be utilized as an indicator of appliance malfunction; it can for example also be developed as an alarm indicator for food preservation temperature tolerances (by becoming red if the temperature is excessive because of appliance malfunction).

According to a variant of the invention, the shelves 7K, 7W and 7X are normal shelves without the means 10 and the means or members associated with them. In that case the spaces A, B, C, D are predefined within the compartment 2 even though with variable volumes (for example they can be defined by the position of particular groups of supports 6 on which to position a shelf at variable heights), in these there being positioned temperature sensors and thermostats associated with a wall 3 or 4 of the compartment 2 and connected to the control means 11 (present in any event). These latter, on noting the temperature setting by the user via the thermostat, act on the fans 65 to maintain the set temperatures within the zones of the compartment 2; temperature control within each zone is obtained via the sensor or sensors located within them.

Other solutions are possible in the light of the present description and are to be considered as lying within the scope of the present document.

The invention claimed is:

1. A refrigerator comprising a refrigerator housing having a compartment, the compartment presenting side walls having brackets for at least one removable element for supporting products to be preserved and separating the compartment into separate zones, the compartment having a rear wall in correspondence with which an evaporator is present, in the rear wall there being provided a plurality of apertures disposed in overlying planes and communicating with the evaporator, a means being provided for measuring the internal temperature of the compartment, the evaporator is located in correspondence with the apertures provided in the rear wall of the compartment, on the apertures there being disposed a means for drawing air from the evaporator to the internal compartment, the air drawing means being mutually independent to enable different independent temperatures to be created within the different zones of the refrigeration compartment, the temperature of each zone being able to be set and modified by a user.

2. A refrigerator as claimed in claim 1, wherein the air drawing means are motor-driven fans.

3. A refrigerator as claimed in claim 1, wherein the rear wall of the compartment comprises a panel located in front of a rear wall of the refrigerator housing, in the panel there being provided the apertures for the air drawing means.

4. A refrigerator as claimed in claim 3, wherein the panel comprises a raised part facing towards the refrigeration compartment, this part being disposed vertically within the compartment, between the raised part and the wall of the refrigerator housing there being present a cavity within which the evaporator is positioned, the cavity at least partly containing the evaporator.

5. A refrigerator as claimed in claim 4, wherein the evaporator lies vertically and comprises at least one finned tube.

6. A refrigerator as claimed in claim 1, wherein the rear wall of the refrigeration compartment comprises further recirculation apertures positioned to the side of the preservation where the air drawing means are disposed, the recirculation apertures enabling air to be recirculated from the refrigeration compartment to the evaporator.

7. A refrigerator as claimed in claim 1, wherein the air drawing means are controlled by control means, the control means controlling the operation of the refrigeration circuit of the refrigerator.

8. A refrigerator as claimed in claim 1, wherein the various zones of the refrigeration compartment in which different temperatures can be obtained, there are provided setting means to enable a desired temperature to be set, and measurement means to enable the temperature present to be measured.

9. A refrigerator as claimed in claim 8, wherein the setting means and the measurement means are associated with each shelf.

10. A refrigerator as claimed in claim 8, wherein the setting means and the measurement means are associated with at least one wall of the refrigeration compartment.

11. A refrigerator as claimed in claim 1, wherein coloured means are provided to define the temperature of utilization of each zone of the refrigeration compartment.

12. A refrigerator as claimed in claim 11, wherein the coloured means are coloured light-emitting means.

13. A refrigerator as claimed in claim 11, wherein the coloured means are coloured bodies, advantageously superposed on a light source.

14. A refrigerator as claimed in claim 11, wherein the coloured means are associated with each shelf.

15. A refrigerator as claimed in claim 11, wherein the coloured means are associated with at least one wall of the refrigeration compartment.

16. A refrigerator as claimed in claim 11, wherein the coloured means change colour on the basis of the temperature present in each zone of the refrigeration compartment.

* * * * *